US008518325B2

(12) United States Patent
Ferrarini et al.

(10) Patent No.: US 8,518,325 B2
(45) Date of Patent: Aug. 27, 2013

(54) METHOD OF STERILIZING A WEB OF PACKAGING MATERIAL

(71) Applicant: Tetra Laval Holdings & Finance S.A., Pully (CH)

(72) Inventors: Filippo Ferrarini, Modena (IT); Giacomo Tarzia, Modena (IT); Silvio Bravaglieri, Ganaceto (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 13/723,953

(22) Filed: Dec. 21, 2012

(65) Prior Publication Data

US 2013/0118125 A1 May 16, 2013

Related U.S. Application Data

(62) Division of application No. 12/085,667, filed as application No. PCT/EP2006/069018 on Nov. 28, 2006, now Pat. No. 8,337,771.

(30) Foreign Application Priority Data

Nov. 29, 2005 (EP) ..... 05425843

(51) Int. Cl.
*A61L 2/18* (2006.01)

(52) U.S. Cl.
USPC ..... 422/28; 53/426

(58) Field of Classification Search
USPC ..... 53/425, 426, 450, 451, 550, 551; 422/26, 27, 28
See application file for complete search history.

(56) References Cited

U.S. PATENT DOCUMENTS

| | | | |
|---|---|---|---|
| 4,537,007 | A | 8/1985 | Lattanzi et al. |
| 5,569,438 | A | 10/1996 | Hilmersson et al. |
| 2003/0177739 | A1 | 9/2003 | Lewis et al. |

FOREIGN PATENT DOCUMENTS

| | | | |
|---|---|---|---|
| DE | 100 28 009 | A1 | 12/2001 |
| EP | 0 286 276 | A | 10/1988 |
| EP | 0 816 233 | A | 1/1998 |
| EP | 1 179 479 | A | 2/2002 |
| EP | 1 334 911 | A | 8/2003 |
| EP | 1 334 911 | A1 | 8/2003 |
| EP | 1 334 912 | A | 8/2003 |

OTHER PUBLICATIONS

International Search Report issued on Feb. 8, 2007 in corresponding International Application Publication No. PCT/EP2006/069018.
Written Opinion of the International Searching Authority issued on Feb. 8, 2007 in corresponding International Application Publication No. PCT/EP2006/069018.

*Primary Examiner* — Sean E Conley
(74) *Attorney, Agent, or Firm* — Buchanan Ingersoll & Rooney PC

(57) ABSTRACT

There is described a unit for sterilizing a web of packaging material, the unit having a bath containing a sterilizing agent in which the web is advanced continuously; and an aseptic environment containing sterile air, connected to an outlet of the bath, and housing drying means for removing residual sterilizing agent from the web; the aseptic environment is divided into two regions by a narrow-section channel, along which the web travels, and which is sized to produce a predetermined difference in pressure between the two regions, and so force air into the channel from the higher-pressure region to the lower-pressure region to dry the web.

17 Claims, 2 Drawing Sheets

1
2
3
4
5
6
7
8
9
10
11
12
13
14
15
16
17
19
22
23
24
25
26
27
28
28a
29
30
31
32
33
34
35
36
37
38
39
40
41
42
43
44
45
46
47
47a
47b
48
49
50
51
A
P1
P2
P3
P4

METHOD OF STERILIZING A WEB OF PACKAGING MATERIAL

This application is a divisional of U.S. application Ser. No. 12/085,667 filed on May 29, 2008, now U.S. Pat. No. 8,337,771 B2, which is a U.S. national stage application based on International Application No. PCT/EP2006/069018 filed on Nov. 28, 2006 and which claims priority under 35 U.S.C. §119 to European Patent Application No. 05425843 filed on Nov. 29, 2005, the entire content of all three of which is incorporated herein by reference.

TECHNICAL FIELD

The present invention relates to a unit for sterilizing a web of packaging material for a machine for packaging pourable food products.

BACKGROUND ART

Machines for packaging pourable food products, such as fruit juice, wine, tomato sauce, pasteurized or long-storage (UHT) milk, etc., are known, on which packages or packs are formed from a continuous tube of packaging material made from a longitudinally sealed web.

The packaging material has a multilayer structure comprising a strong, stiff base layer, which may comprise a layer of fibrous material, such as paper, or material such as mineral-filled polypropylene. The base layer is covered on both sides with layers of heat-seal plastic material, such as polyethylene film, and, in the case of aseptic packages for long-storage products, such as UHT milk, the packaging material comprises a layer of oxygen-barrier material, such as aluminium or ethyl vinyl alcohol (EVOH) foil, which is superimposed on a layer of heat-seal plastic material, and is in turn covered with another layer of heat-seal plastic material defining the inner face of the package eventually contacting the food product.

To produce the above packages, the web of packaging material is unwound off a reel and fed through a sterilizing unit, in which it is typically sterilized by immersion in a bath of liquid sterilizing agent, such as a concentrated hydrogen peroxide and water solution.

More specifically, the sterilizing unit comprises a bath filled, in use, with the sterilizing agent, into which the web is fed continuously. The bath conveniently comprises two parallel vertical branches connected at the bottom to define a U-shaped path long enough to allow enough time to treat the packaging material. For effective, relatively fast treatment, thus enabling a reduction in the size of the sterilizing chamber, the sterilizing agent must be maintained at a high temperature, e.g. of around 70° C.

The sterilizing unit also defines an aseptic environment connected to the outlet of the bath, and in which the web of packaging material is dried and subsequently folded and sealed longitudinally to form a vertical tube, which is then filled continuously with the food product for packaging.

More specifically, in the aseptic environment, the web is treated to eliminate any residual sterilizing agent, the amount of which permitted in the packaged food product is governed by strict regulations (the maximum amount permitted being in the region of a fraction of a part per million).

The above treatment normally comprises a preliminary operation, whereby the drops on the packaging material are removed mechanically, and air drying.

Preliminary removal of the drops may be performed, for example, by means of a pair of squeeze rollers conveniently located close to the inlet of the aseptic environment; the packaging material is fed between the rollers and comes out still covered with a film of sterilizing agent, but with no macroscopic drops.

Drying may be performed using air knives directed onto the opposite faces of the web of packaging material, supplied with sterile air, and for evaporating any leftover traces of sterilizing agent.

Before leaving the aseptic environment, the web is folded into a cylinder and sealed longitudinally to form a continuous vertical tube in known manner. The tube of packaging material, in effect, forms an extension of the aseptic environment, and is filled continuously with the pourable food product, and then fed to a (transverse) form-and-seal unit for forming the individual packages, and in which the tube is gripped and sealed between pairs of jaws to form pillow packs.

The pillow packs are separated by cutting the sealed portions between the packs, and are then fed to a final folding station where they are folded mechanically into the finished form.

Packaging machines of the type described above are used widely and satisfactorily in a wide range of food industries to produce aseptic sealed packages from a web of packaging material. Performance of the sterilizing units of such machines, in particular, ensures ample compliance with regulations governing sterility of the packages.

Within the industry, however, a need for further improvement is felt, particularly in view of the continual increase in the output rate of such packaging machines.

Continually increasing the output rate obviously reduces the time available to remove all the residual sterilizing agent from each portion of the packaging material web travelling through the aseptic environment.

DISCLOSURE OF INVENTION

It is an object of the present invention to provide a unit for sterilizing a web of packaging material, designed, even alongside drastic increases in output rate, to ensure ample compliance with regulations governing the permissible amount of residual sterilizing agent on the finished packages.

According to the present invention, there is provided a unit for sterilizing a web of packaging material for a machine for packaging pourable food products, said unit comprising a bath containing a sterilizing agent in which said web is advanced continuously; and an aseptic environment containing sterile air, connected to an outlet of said bath, and housing drying means for removing residual sterilizing agent from said web; characterized in that said aseptic environment is divided into two regions by a narrow-section channel, along which said web travels, and which is sized to produce a predetermined difference in pressure between said two regions, and so force air into the channel from the higher-pressure region to the lower-pressure region to dry said web.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
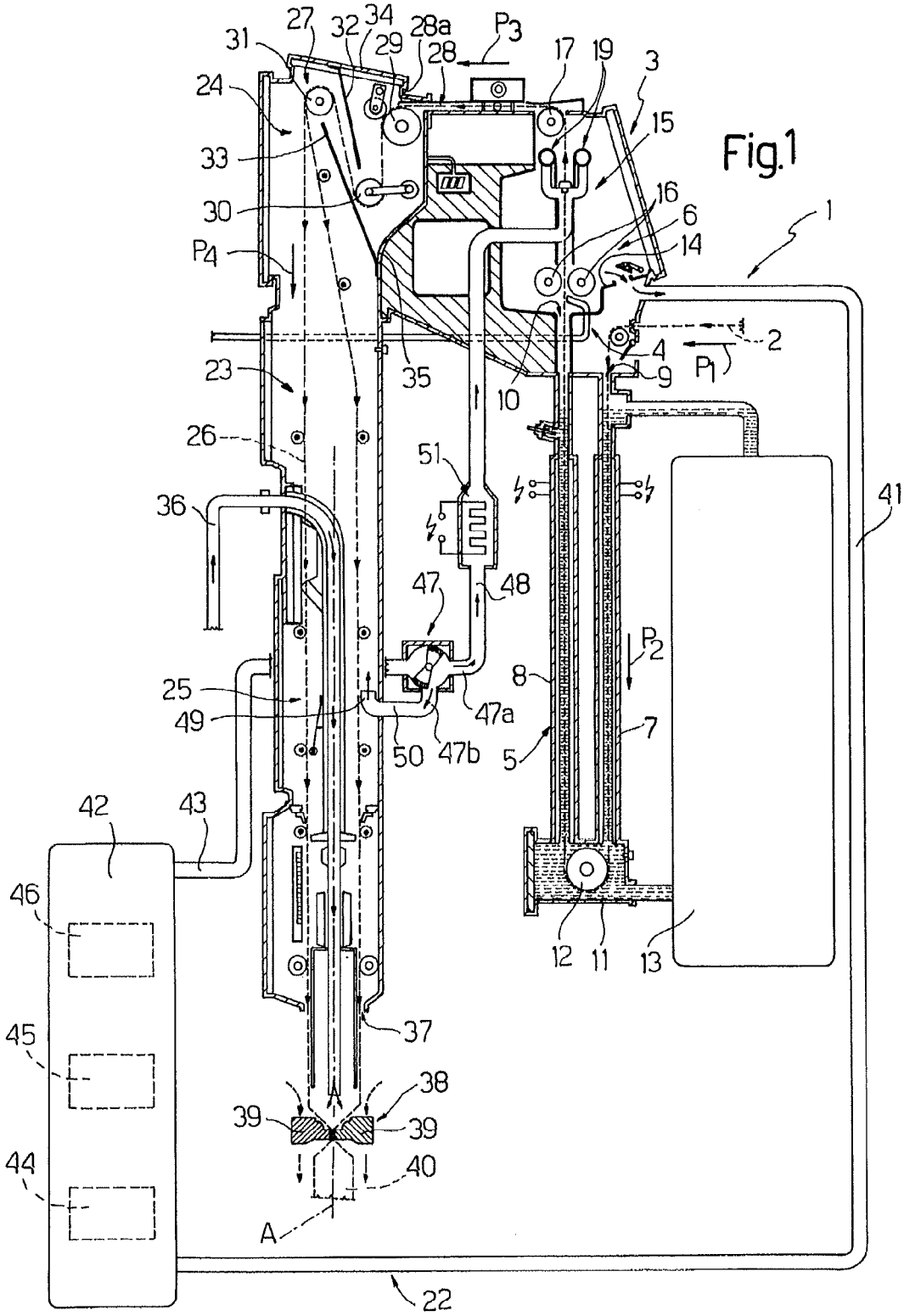
FIG. 1 shows a diagram of a machine for packaging pourable food products and featuring a sterilizing unit in accordance with the teachings of the present invention.

Number 1 in FIG. 1 indicates as a whole a packaging machine for continuously producing aseptic sealed packages of a pourable food product from a web of packaging material 2 (hereinafter referred to simply as "web 2").

Machine 1 comprises a sterilizing unit 3, to which web 2 is fed off a reel (not shown) along a path $P_1$.

Sterilizing unit 3 comprises a transition chamber 4, into which web 2 is first fed; a sterilizing bath 5 containing a liquid sterilizing agent, e.g. a 30% solution of hydrogen peroxide ($H_2O_2$) and water, through which web 2 is fed; and a process chamber 6, in which web 2 is dried, as explained in detail below.

Bath 5 is substantially defined by a U-shaped conduit filled, in use, with sterilizing agent to a predetermined level. The U-shaped conduit is defined by two vertical, respectively inlet and outlet, branches 7, 8 having respective top openings 9, 10, which respectively define the inlet and outlet of web 2 into and out of bath 5, and communicate respectively with transition chamber 4 and process chamber 6. The two branches 7, 8 are connected at the bottom by a bottom portion 11 of bath 5 housing a horizontal-axis guide roller 12.

Inside bath 5, web 2 therefore describes a U-shaped path $P_2$ of such a length as to keep the packaging material long enough inside the sterilizing agent.

Bath 5 is connected to a peroxide control circuit 13—known and therefore not shown in detail—and is maintained, in use, at a controlled temperature, e.g. of around 70° C.

Process chamber 6 is located above transition chamber 4, is separated from it by a partition 14, and houses drying means, indicated as a whole by 15, for removing residual sterilizing agent from web 2.

Drying means 15 comprise two idle squeeze rollers 16 having parallel horizontal axes, located close to the inlet of process chamber 6, on opposite sides of web 2, and at least one of which is covered with relatively soft material. Squeeze rollers 16 exert pressure on respective opposite faces of web 2 to squeeze the drops of sterilizing agent out and back into bath 5.

Downstream from squeeze rollers 16, web 2 is diverted onto a horizontal path $P_3$ by a guide roller 17.

Drying means 15 also comprise two so-called "air knives" 19—known and shown only schematically—located on opposite sides of web 2, and each defined (FIG. 2) by a nozzle 20 for directing an air jet onto a relative face of web 2, and by a wall 21 for guiding the jet, in use, in a direction substantially parallel to, but opposite to the travelling direction of, web 2.

Nozzles 20 form part of an air processing circuit 22 described in detail below.

Sterilizing unit 3 also comprises a vertical aseptic chamber 23 or tower, which has a top portion 24 communicating with process chamber 6, and an elongated bottom portion 25, in which web 2 is folded into a cylinder and sealed longitudinally to form a continuous tube 26 of packaging material having a vertical axis A. Aseptic chamber 23 and process chamber 6 together therefore form an aseptic environment 27.

A narrow-section channel 28, through which web 2 travels, divides aseptic environment 27 into two regions corresponding, in the example shown, to aseptic chamber 23 and process chamber 6 respectively.

More specifically, as shown in the accompanying drawings, channel 28 extends horizontally along path $P_3$ of web 2, and connects process chamber 6 to top portion 24 of aseptic chamber 23.

Channel 28 is advantageously sized to produce a predetermined difference in pressure between the two regions or chambers 6, 23, and so force air into channel 28 from the higher-pressure chamber (23) to the lower-pressure chamber (6) to effectively dry web 2.

Channel 28 is preferably sized so that the pressure in aseptic chamber 23 is at least three times the pressure in process chamber 6. For example, the pressure in aseptic chamber 23 may reach approximately 600 Pa, and the pressure in process chamber 6 may reach approximately 100 Pa.

The air inside channel 28 therefore flows in the opposite direction to the travelling direction of web 2 along path $P_3$.

In the example shown, which refers to a web 2 of roughly 33 cm in width, the walls facing the web, i.e. the top and bottom wall of channel 28, are no more than 6 mm, and preferably 3 mm or less, away from web 2.

As shown in the accompanying drawings, top portion 24 of aseptic chamber 23 houses a number of rollers 29, 30, 31 for guiding web 2 from horizontal path $P_3$ to a vertical path $P_4$ parallel to axis A of tube 26. More specifically, roller 29 is powered and located immediately downstream from channel 28; roller 30 is idle and defines a tensioner; and roller 31 is idle and guides web 2 downwards.

Figure 2:
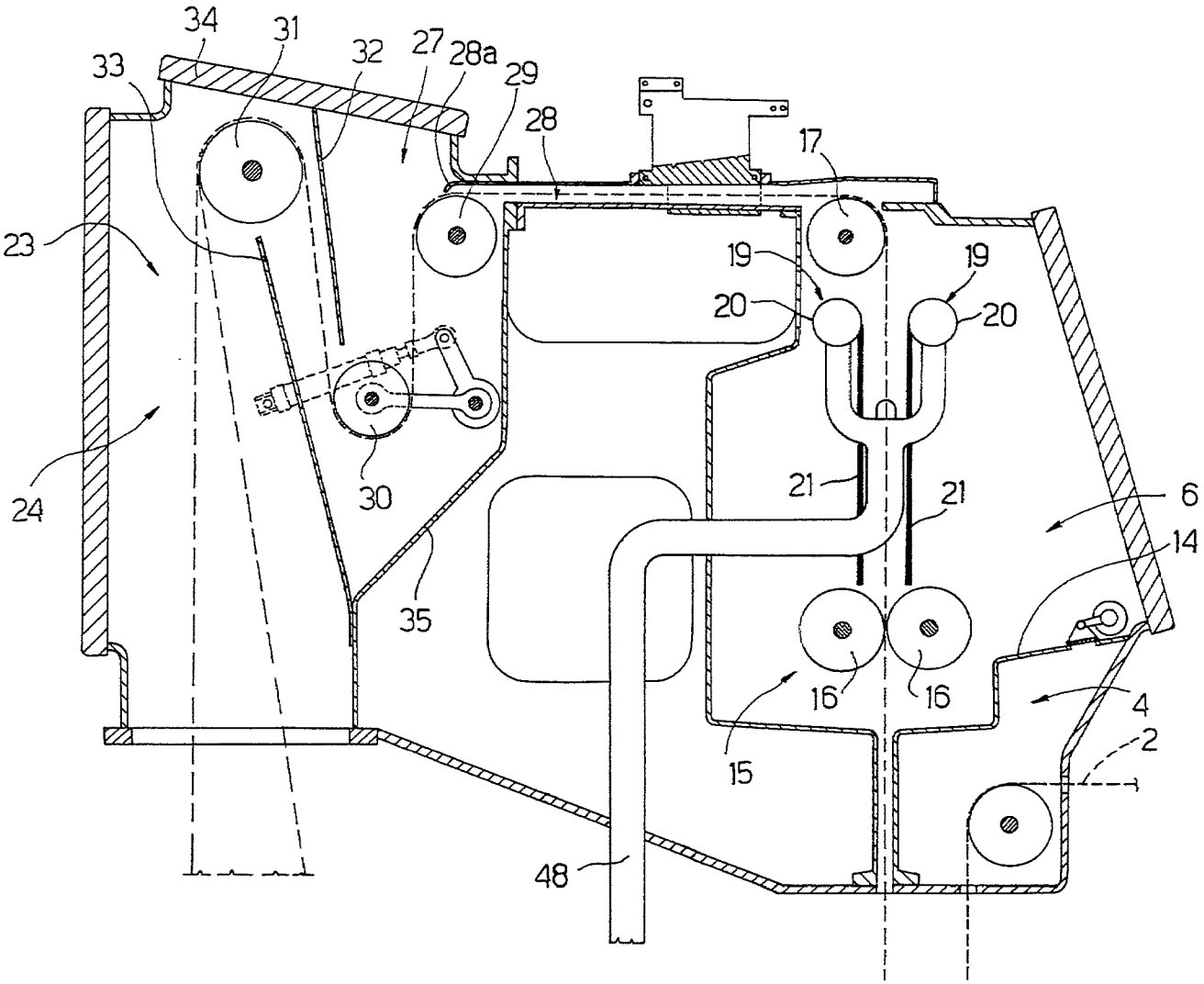
FIG. 2 shows a larger-scale schematic view of part of the FIG. 1 sterilizing unit.

As shown particularly in FIG. 2, where channel 28 comes out inside chamber 23—hereinafter referred to simply as outlet 28*a*—the wall of channel 28 extends partly over, and has an end converging with, roller 29.

Top portion 24 of aseptic chamber 23 houses two baffles 32, 33 for producing turbulence in the air close to outlet 28*a* of channel 28, and so assisting removal of any further sterilizing agent left on web 2.

As shown in the accompanying drawings, baffle 32 is located closer than baffle 33 to outlet 28*a* of channel 28, and extends from a top wall 34 of chamber 23 towards roller 30; while baffle 33 extends towards roller 31 from a wall 35 of chamber 23 lower down than wall 34. Baffles 32 and 33 diverge slightly towards top wall 34.

Tube 26, formed downstream from roller 31 in known manner not described, is filled continuously with the product for packaging by means of a fill conduit 36, and comes out downwards through a bottom opening 37 in aseptic chamber 23, of which it substantially forms an extension.

Machine 1 comprises a known transverse form-and-seal unit 38, not shown in detail, in which tube 26 of packaging material is gripped between pairs of jaws 39, which seal tube 26 transversely to form aseptic pillow packs 40 eventually formed by known cutting and folding operations into individual packages.

Air processing circuit 22 comprises an intake conduit 41 communicating with transition chamber 4; and a known processing unit 42, not described in detail, having an inlet connected to conduit 41, and an outlet connected to a conduit 43 for feeding processed air into sterilizing unit 3. Processing unit 42 conveniently comprises, in known manner, a compressor 44; cleansing means 45 for removing residual sterilizing agent; and heating means 46 for heating and sterilizing the air. Conduit 43 is connected to an inlet of a three-way distributor 47 having an outlet 47*a* connected by a conduit 48 to nozzles 20 of air knives 19, and an outlet 47*b* connected by a conduit 50 to one or more inlets 49 for feeding air into bottom portion 25 of aseptic chamber 23. In normal operating conditions, distributor 47 conveniently feeds 66% of the incoming airflow to aseptic chamber 23, and the remaining 33% to process chamber 6. An electric heater 51 is housed in conduit 48.

The air fed to aseptic chamber 23 by conduit 50 is at a temperature of about 120° C., while the air fed to process chamber 6 by conduit 48 and heater 51 is at a temperature of about 180-190° C.

In actual use, after being sterilized by immersion in bath 5, web 2 is fed into process chamber 6, where it first passes through squeeze rollers 16 to mechanically remove the drops of sterilizing agent from web 2.

Next, web 2 is first swept by sterile-air jets from air knives 19, and then diverted by roller 17 along path $P_3$ to channel 28.

Along channel 28, a strong air current flows over, thus effectively drying, web 2. The very narrow section of channel 28, on the one hand, increases the effectiveness of the air current on web 2, and, on the other, produces a drastic fall in pressure between aseptic chamber 23 and process chamber 6, thus increasing the force of the air stream flowing over web 2.

At the outlet of channel 28, any remaining sterilizing agent is removed from web 2 by the turbulence in the air in the region of baffles 32 and 33.

Web 2 is then folded into a cylinder and sealed longitudinally to form tube 26, which is filled continuously with the pourable food product from conduit 36, and is gripped and sealed transversely by jaws 39 to form a succession of packs 40.

The advantages of sterilizing unit 3 according to the present invention will be clear from the foregoing description.

In particular, by means of narrow-section channel 28 between aseptic chamber 23 and process chamber 6, a strong current of hot air can be generated in channel 28 and maintained closely contacting web 2 to effectively dry web 2. Even alongside drastic increases in packaging machine output rates, therefore, sterilizing unit 3 safely ensures compliance with current regulations governing the permissible amount of residual sterilizing agent on the packaging material of the finished packages.

Clearly, changes may be made to sterilizing unit 3 as described and illustrated herein without, however, departing from the scope defined in the accompanying Claims.

The invention claimed is:

1. A method for sterilizing a web of packaging material for packaging pourable food products, the method comprising:

continuously advancing the web through sterilizing agent in a bath;

advancing the web, which has advanced through the sterilizing agent, through an aseptic environment containing sterile air, the aseptic environment being divided into two regions by a channel sized to produce a difference in pressure between the two regions so that the two regions comprise a lower-pressure region and a higher-pressure region, the channel possessing a first open end opening into the higher-pressure region and a second open end opening into the lower-pressure region, the higher-pressure region possessing an interior wall, the lower-pressure region possessing an interior wall spaced from the higher-pressure region interior wall, the channel possessing a pair of opposing walls, each opposing wall extending between the lower-pressure region interior wall and the higher-pressure region interior wall, wherein the web is shaped into a sealable package inside the higher-pressure region; and the advancing of the web comprising advancing the web through the lower-pressure region, through the channel and through the higher-pressure region as air is forced into the channel from the higher-pressure region toward the lower-pressure region to dry the web.

2. The method according to claim 1, further comprising drying the web with air knives positioned in the lower-pressure region.

3. The method according to claim 1, further comprising producing turbulence in the air in the higher-pressure region to facilitate removal of residual sterilizing agent on the web.

4. The method according to claim 1, further comprising producing turbulence in the air in the higher-pressure region by way of at least one baffle positioned in the higher-pressure region to facilitate removal of residual sterilizing agent on the web.

5. The method according to claim 1, further comprising producing turbulence in the air in the higher-pressure region by way of a pair of baffles positioned in the higher-pressure region to facilitate removal of residual sterilizing agent on the web.

6. The method according to claim 1, wherein the web is advanced through the channel so that the web is spaced no more than 6 mm from walls of the channel which face the web.

7. The method according to claim 1, wherein the web is advanced through the lower-pressure region before being advanced through the channel and the higher-pressure region.

8. The method according to claim 1, wherein the channel possesses a height and a length, the length of the channel being greater than the height of the channel.

9. A method for sterilizing a web of packaging material for packaging pourable food products, the method comprising:

continuously advancing the web through sterilizing agent in a bath toward an outlet of the bath;

advancing the web, which has advanced through the sterilizing agent and the outlet of the bath, through an aseptic environment containing sterile air, the aseptic environment comprising a process chamber, a channel and an aseptic chamber wherein the web is shaped into a sealable package, the process chamber being connected to the outlet of the bath and bounded by an interior wall, the aseptic chamber being bounded by an interior wall which is spaced from the interior wall bounding the process chamber, the channel possessing a first end connected to the interior wall bounding the aseptic chamber and opening into the aseptic chamber and a second end connected to the interior wall bounding the process chamber and opening into the process chamber, the channel being sized to produce a difference in pressure between the aseptic chamber and the process chamber so that the pressure in the aseptic chamber is at least three times higher than the pressure in the process chamber so that the sterile air flows through the channel from the aseptic chamber to the process chamber; and the advancing of the web through the aseptic environment comprising advancing the web through the process chamber, through the channel and through the aseptic chamber as air flows through the channel from the aseptic chamber toward the process chamber to dry the web.

10. The method according to claim 9, further comprising drying the web with air knives positioned in the process chamber.

11. The method according to claim 9, further comprising producing turbulence in the air in the aseptic chamber to facilitate removal of residual sterilizing agent on the web.

12. The method according to claim 9, further comprising producing turbulence in the air in the aseptic chamber by way of at least one baffle positioned in the aseptic chamber to facilitate removal of residual sterilizing agent on the web.

13. The method according to claim 9, wherein the web is advanced through the channel so that the web is spaced no more than 6 mm from walls of the channel which face the web.

14. The method according to claim 9, wherein the channel includes a top wall facing one surface of the web as the web advances through the channel, the channel including a bottom wall facing an opposite surface of the web as the web advances through the channel, and wherein the channel is sized so that the distance between the top wall of the channel and the one surface of the web as the web advances through the channel is 3 mm or less, and the distance between the bottom wall of the channel and the opposite surface of the web as the web advances through the channel is 3 mm or less.

15. A method of producing a sealable package for a pourbale food product from a web of packaging material, the method comprising:

continuously advancing the web through sterilizing agent in a bath;

advancing the web, which has advanced through the sterilizing agent, through an aseptic environment containing sterile air, the aseptic environment being divided into two regions by a channel sized to produce a difference in pressure between the two regions so that the two regions comprise a lower-pressure region and a higher-pressure region, the channel possessing a first open end opening into the higher-pressure region and a second open end opening into the lower-pressure region, the higher-pressure region possessing an interior wall, the lower-pressure region possessing an interior wall spaced from the higher-pressure region interior wall, the channel extending between the lower-pressure region interior wall and the higher-pressure region interior wall;

the advancing of the web comprising advancing the web through the lower-pressure region, through the channel and through the higher-pressure region as air is forced into the channel from the higher-pressure region toward the lower-pressure region to dry the web; and shaping the web into the sealable package inside the higher-pressure region.

16. The method according to claim 15, the shaping of the web into the sealable package comprises forming the web into a cylinder.

17. The method according to claim 15, further comprising filling the sealable package with the pourable food product and sealing the sealable package.

* * * * *